US008949113B2

(12) United States Patent
Holmberg et al.

(10) Patent No.: US 8,949,113 B2
(45) Date of Patent: Feb. 3, 2015

(54) SOUND PERCEPTION USING FREQUENCY TRANSPOSITION BY MOVING THE ENVELOPE

(75) Inventors: Marcus Holmberg, Smørum (DK); Thomas Kaulberg, Smørum (DK); Jan Mark de Haan, Smørum (DK)

(73) Assignee: Oticon A/S, Smorum (DK)

( * ) Notice: Subject to any disclaimer, the term of this patent is extended or adjusted under 35 U.S.C. 154(b) by 906 days.

(21) Appl. No.: 13/080,893

(22) Filed: Apr. 6, 2011

(65) Prior Publication Data

US 2011/0249843 A1 Oct. 13, 2011

Related U.S. Application Data

(60) Provisional application No. 61/322,306, filed on Apr. 9, 2010.

(30) Foreign Application Priority Data

Apr. 9, 2010 (EP) ..... 10159456

(51) Int. Cl.
*G10L 19/00* (2013.01)
*H04R 25/00* (2006.01)

(52) U.S. Cl.
CPC ..... *H04R 25/353* (2013.01); *H04R 2225/43* (2013.01); *H04R 25/407* (2013.01)
USPC ..... 704/200.1; 704/201; 704/203; 704/205; 704/500

(58) Field of Classification Search
CPC ..... G10L 19/00; G10L 19/02; G10L 19/0204; G10L 19/0208; G10L 21/02
USPC ..... 704/200.1, 201, 203, 205, 500
See application file for complete search history.

(56) References Cited

U.S. PATENT DOCUMENTS 6,173,062 B1 * 1/2001 Dibachi et al. ..... 381/312
6,353,671 B1 3/2002 Kandel (Continued)

FOREIGN PATENT DOCUMENTS

EP 0 054 450 A1 6/1982
EP 1 333 700 A2 8/2003

(Continued)

OTHER PUBLICATIONS

Simpson, "Frequency-Lowering Devices for Managing High-Frequency Hearing Loss: A Review", Trends in Amplification, vol. 13, No. 2, pp. 87-106 (2009).

(Continued)

*Primary Examiner* — Qi Han
(74) *Attorney, Agent, or Firm* — Birch, Stewart, Kolasch & Birch, LLP

(57) ABSTRACT

A method of operating an audio processing device to improve a user's perception of an input sound includes defining a critical frequency $f_{crit}$ between a low frequency range and a high frequency range, receiving an input sound by the audio processing device, and analyzing the input sound in a number of frequency bands below and above the critical frequency. The method also includes defining a cut-off frequency $f_{cut}$ below the critical frequency $f_{crit}$, identifying a source frequency band above the cut-off frequency $f_{cut}$, and extracting an envelope of the source band. Further, the method identifying a corresponding target band below the critical frequency $f_{crit}$, extracting a phase of the target band, and combining the envelope of the source band with the phase of the target band.

26 Claims, 11 Drawing Sheets

(56) References Cited

U.S. PATENT DOCUMENTS

| | | | | |
|---|---|---|---|---|
| 6,680,972 | B1 * | 1/2004 | Liljeryd et al. | 375/240 |
| 2006/0253209 | A1 * | 11/2006 | Hersbach et al. | 700/94 |
| 2010/0049522 | A1 | 2/2010 | Tamura et al. | |
| 2010/0198603 | A1 * | 8/2010 | Paranjpe | 704/500 |
| 2010/0246866 | A1 * | 9/2010 | Swain et al. | 381/315 |

FOREIGN PATENT DOCUMENTS

| | | | |
|---|---|---|---|
| EP | 1 441 562 | A2 | 7/2004 |
| EP | 1 460 769 | A1 | 9/2004 |
| EP | 1 686 566 | A2 | 8/2006 |
| EP | 1 981 253 | A1 | 10/2008 |
| EP | 2 081 405 | A1 | 7/2009 |
| EP | 2 091 266 | A1 | 8/2009 |
| EP | 2 169 983 | A2 | 3/2010 |
| WO | WO 99/14986 | | 3/1999 |
| WO | WO 2005/015952 | A1 | 2/2005 |
| WO | WO 2008/125291 | A2 | 10/2008 |
| WO | WO 2009/132646 | A1 | 11/2009 |

OTHER PUBLICATIONS

Timms, "Speech Processing Strategies Based on the Sinusoidal Speech Model for the Profoundly Hearing Impaired", Diss. ETH No. 15167, pp. 36-46 (2003).

Vaidyanathan, "Multirate Systems and Filter Banks" Prentice Hall, pp. 113-117 (1993).

* cited by examiner

SOUND PERCEPTION USING FREQUENCY TRANSPOSITION BY MOVING THE ENVELOPE

CROSS REFERENCE TO RELATED APPLICATIONS

This nonprovisional application claims priority under 35 USC 119(e) to U.S. Provisional Application No. 61/322,306 filed on Apr. 9, 2010 and under 35 USC 119(a) to patent application Ser. No. 10159456.2 filed in Europe on Apr. 9, 2010. The entire contents of all of the above applications are hereby incorporated by reference.

TECHNICAL FIELD

The present application relates to improvements in sound perception, e.g. speech intelligibility, in particular to improving sound perception for a person, e.g. a hearing impaired person. The disclosure relates specifically to a method of improving a user's perception of an input sound.

The application furthermore relates to an audio processing device and to its use.

The application further relates to a data processing system comprising a processor and program code means for causing the processor to perform at least some of the steps of the method and to a computer readable medium storing the program code means.

The disclosure may e.g. be useful in applications such as communication devices, e.g. telephones, or listening devices, e.g. hearing instruments, headsets, head phones, active ear protection devices or combinations thereof.

BACKGROUND ART

The following account of the prior art relates to one of the areas of application of the present application, hearing aids.

The basic idea of frequency compression or frequency transposition in general is to make frequencies, that are inaudible for a person (having a specific hearing impairment) with conventional amplification, audible by moving them. The fact that it is not possible—with conventional hearing aids—to compensate a hearing impairment at some frequencies can have several reasons. The two most likely reasons are 1) that the amplification cannot be made high enough due to feedback oscillation issues, or 2) that the patient has "dead regions", where hearing ability is severely degraded or nonexistent. Dead regions theoretically would indicate regions of the basilar membrane where the sensory cells (the inner hair cells) do not function. Very strong amplification would then not help that location of the basilar membrane. Frequency lowering or transposition could in such cases be a solution, where information at an inaudible frequency is moved to an audible range.

Nonlinear frequency compression (NFC) has so far shown the best results of the different frequency lowering techniques (see [Simpson; 2009] for an overview of different signal processing approaches). NFC has been shown to improve speech intelligibility for hearing impaired users in certain circumstances. In NFC, the frequency axis is divided into a linear part and a compressed part (cf. e.g. FIG. 1*a* showing a non-compressed (linear, $f_{in}=f_{out}$) part and a compressed ($f_{in}>f_{out}$) part at frequencies, respectively, below and above a predetermined cut-off frequency, $f_{cut}$).

WO 2005/015952 (Vast Audio) describes a system that aims at improving the spatial hearing abilities of hearing-impaired subjects. The proposed system discards every $n^{th}$ frequency analysis band and pushes the remaining ones together, thus applying frequency compression. As a result, spatially salient high-frequency cues are assumed to be reproduced at lower frequencies.

EP 1 686 566 A2 (Phonak) deals with a signal processing device comprising means for transposing at least part of an input signal's spectral representation to a transposed output frequency, the frequency transposition means being configured to process the portion of the input signal spectral representation such that a phase relationship that existed in the input signal's spectral representation is substantially maintained in the transposed portion of the spectral representation.

EP 2 091 266 A1 (Oticon) deals with the transformation of temporal fine structure-based information into temporal envelope-based information in that a low frequency source band is transposed to a high frequency target band in such a way that the (low-frequency) temporal fine structure cues are moved to a higher frequency range. Thereby the ability of hearing-aid users to access temporal fine structure-based cues can be improved.

DISCLOSURE OF INVENTION

The concept of the present disclosure can e.g. be used in a system with a compression scheme as shown in FIG. 1*a*, or a system compressing the whole frequency range, or some other frequency transposition principle (cf. examples of compression/expansion schemes in FIG. 3).

In the present application the terms 'frequency transposition', 'frequency lowering', 'frequency compression' and 'frequency expansion' are used. The term 'frequency transposition' can imply a number of different approaches to altering the spectrum of a signal, e.g. 'frequency lowering' or 'frequency compression' or even 'frequency expansion'. The term 'frequency compression' is taken to refer to the process of compressing a relatively wider source frequency region into a relatively narrower target frequency region, e.g. by discarding every $n^{th}$ frequency analysis band and "pushing" the remaining bands together in the frequency domain. Correspondingly, the term 'frequency expansion' is taken to refer to the process of expanding a relatively narrower source frequency region to a relatively wider target frequency region, e.g. by broadening the source bands when transposed to target bands and/or creating a number of synthetic target bands to fill out the extra frequency range. The term 'frequency lowering' is taken to refer to the process of shifting a high-frequency source region into a lower-frequency target region. In some prior art applications, this occurs without discarding any spectral information contained in the shifted high-frequency band (i.e. the higher frequencies that are transposed either replace the lower frequencies completely or they are mixed with them). This is, however, not the case in the present disclosure. The present application typically applies frequency compression by frequency lowering, wherein the envelope of a (higher frequency) source band is mixed with the phase of a (lower frequency) source band.

Typically, one or more relatively higher frequency source bands are transposed downwards into one or more relatively lower frequency target bands. Typically, one or more even lower frequency bands remain unaffected by the transposition. Further, one or more even higher frequency bands may not be considered as source bands.

In prior art frequency lowering devices or schemes, both the envelope and the fine structure (the phase) information is moved. This causes sound quality degradations and severely limits the flexibility of the system. For instance, the human auditory system is very sensitive to phase information at low frequencies (e.g. frequencies below 1.5 kHz), and therefore frequency lowering is presently not applied at low frequencies.

An object of the present application is to increase the sound quality of a sound signal as perceived by a user, e.g. a hearing impaired user. A further object is to improve speech intelligibility, e.g. in frequency lowering systems. A further object is to increase the possibilities of providing an appropriate fitting for different types of hearing impairment. A further object is to improve the sound perception of an audio signal transmitted and received via a transmission channel.

Objects of the application are achieved by the invention described in the accompanying claims and as described in the following.

A main element of the present disclosure is the transposition of the envelope information, but not the phase information of an incoming sound signal.

A Method of Improving a User'S Perception of an Input Sound

An object of the application is achieved by a method of improving a user's perception of an input sound. The method comprises, a) Defining a critical frequency $f_{crit}$ between a low frequency range and a high frequency range;
b) Analyzing an input sound in a number of frequency bands below and above said critical frequency;
c) Defining a cut-off frequency $f_{cut}$ below said critical frequency $f_{crit}$;
d) Identifying a source frequency band above said cut-off frequency $f_{cut}$;
e) Extracting the envelope of said source band;
f) Identifying a corresponding target band below said critical frequency $f_{crit}$;
g) Extracting the phase of said target band;
h) Combining the envelope of said source band with the phase of said target band.

This has the advantage of increasing the sound quality, and the potential to further improve speech intelligibility in frequency transposition, e.g. frequency lowering systems.

The term 'perception of an input sound' is taken to include audibility and speech intelligibility.

In an embodiment, the critical frequency is smaller than 8 kHz, such as smaller than 5 kHz, such as smaller than 3 kHz, such as smaller than 2.5 kHz, such as smaller than 2 kHz, such as smaller than 1.5 kHz.

In an embodiment, the target bands are located between said cut-off frequency $f_{cut}$ and said critical frequency $f_{crit}$.

In an embodiment, the cut-off frequency is located in a range from 0.01 kHz to 5 kHz, e.g. smaller than 4 kHz, such as smaller than 2.5 kHz, such as smaller than 2 kHz, such as smaller than 1.5 kHz, such as smaller than 1 kHz, such as smaller than 0.5 kHz, such as smaller than 0.02 kHz.

In an embodiment, the source bands are located between said cut-off frequency $f_{cut}$ and a maximum source band frequency $f_{max\text{-}s}$.

In an embodiment, the maximum source band frequency $f_{max\text{-}s}$ is smaller than 12 kHz, such as smaller than 10 kHz, such as smaller than 8 kHz, such as smaller than 6 kHz, such as smaller than 3 kHz, such as smaller than 2 kHz, such as smaller than 1.5 kHz.

In an embodiment, the maximum source band frequency $f_{max\text{-}s}$ is smaller than the maximum input frequency $f_{max\text{-}i}$ of the input sound signal.

In an embodiment, the critical frequency $f_{crit}$ is defined relative to a user's hearing ability, e.g. as a frequency above which the user has a degraded hearing ability. A degraded hearing ability in a given frequency range is in the present context taken to mean a hearing loss that is more than 10 dB SPL (SPL=Sound Pressure Level) lower (e.g. more than 20 dB lower) than a hearing threshold of an average normally hearing listener in that frequency range.

In an embodiment, the critical frequency $f_{crit}$ is defined dependent on a user's hearing ability and the available gain. The available gain is dependent on the given listening device (e.g. a specific hearing instrument), the specific fitting to the user, acoustic feedback conditions, etc.

In an embodiment, the critical frequency $f_{crit}$ is defined dependent on an upper frequency of a bandwidth to be transmitted in a transmission channel, $f_{crit}$ being e.g. equal to such upper frequency.

In an embodiment, the (output) frequency range is not compressed or expanded below the cut-off frequency $f_{cut}$ ($f_{in}=f_{out}$) (cf. e.g. FIG. 3*b*). In an embodiment, the output frequency range is compressed at frequencies below the cut-off frequency $f_{cut}$ (cf. e.g. FIG. 3*c*, curve denoted $g_2(f_{in})$). Alternatively, the output frequency range may be expanded at frequencies below the cut-off frequency $f_{cut}$ (cf. e.g. FIG. 3*b*, curve denoted 1:3).

Given a value of the critical frequency $f_{crit}$, the cut-off frequency $f_{cut}$ is on the one hand preferably relatively large to provide an acceptable sound quality, e.g. to provide an acceptable speech intelligibility (e.g. to avoid vowel confusion). On the other hand, $f_{cut}$ is preferably relatively small to avoid a too large compression ratio. In other words, a compromise has to be made between sound quality/speech intelligibility and compression ratio.

In an embodiment, the frequency transposition scheme is automatically switched on and off depending on the type of signal currently being considered (e.g. noise (off), voice (on), music (off)).

In an embodiment, an appropriate compression or expansion scheme may be selected depending on the type of input signal currently being considered (type being e.g. speech, music, noise, vowel, consonant, type of consonant, dominated by high frequency components, dominated by low frequency components, signal to noise ratio, etc.). In an embodiment, a differentiation between vowels and consonants and different consonants is based on an automatic speech recognition algorithm.

In an embodiment, the method comprises providing that one or more source bands are pre-processed before its/their envelope is/are extracted. In an embodiment, the method comprises providing that the pre-processing comprises a summation or weighting or averaging or max/min identification of one or more source bands before a resulting envelope is extracted.

In an embodiment, the method comprises providing that a post-processing of an extracted source band envelope value is performed before the source band envelope is mixed with the target band phase. In an embodiment, the method comprises providing that the post-processing comprises smoothing in the time domain, e.g. comprising a generating a weighted sum of values of the envelope in a previous time span, e.g. in a number of previous time frames. In an embodiment, the method comprises providing that the post-processing comprises a linear or non-linear filtering process, e.g. implementing different attack and release times and/or implementing input level dependent attack and release times.

In an embodiment, the method comprises compressing the frequency range of an audio signal above a cut-off frequency with a predefined compression function (e.g. a predefined compression ratio) adapted to a specific transmission channel and transmitting the compressed signal via the transmission channel. In an embodiment the method further comprises receiving the transmitted signal end expanding the received signal with a predefined expansion function (e.g. a predefined compression ratio) corresponding to the compression function (e.g. being the inverse of). In the expansion process, the compressed part of the signal may be expanded by widening each compressed band to fill out the full frequency range of the original signal, each magnitude value of the compressed signal thus representing a magnitude of an expanded band. The phase values of the compressed bands may be expanded likewise. Alternatively, the phase values of the expanded bands may be synthesized (e.g. to provide a randomly distributed, or a constant phase). Alternatively, the phase information of the original signal (before compression) is coded and transmitted over the (low-bandwidth) transmission channel and used to regenerate the phase of the expanded signal. This method can e.g. be used to transmit a full bandwidth audio signal over a transmission channel having a reduced bandwidth thereby saving transmission bandwidth (and power) or improving the sound perception of a signal transmitted over a fixed bandwidth channel, e.g. a telephone channel. This has the potential of improving sound quality, and possibly speech intelligibility in case the signal is a speech signal (e.g. of a telephone conversation).

An Audio Processing Device:

An audio processing device is furthermore provided by the present application. The audio processing device comprises a) An input signal unit for providing an electric input sound signal;
b) A time to time-frequency conversion unit for providing the electric input signal in a number of frequency bands;
c) A frequency analyzing unit for analyzing the electric input sound signal in a number of frequency bands below and above a critical frequency $f_{cut}$;
d) A signal processing unit comprising a frequency transposition scheme for identifying a source frequency band above a cut-off frequency $f_{cut}$ below said critical frequency $f_{crit}$ and for identifying a corresponding target band below said critical frequency $f_{crit}$;
e) An envelope extraction unit for extracting the envelope of said source band;
f) A phase extraction unit for extracting the phase of said target band;
g) A combination unit for combining the extracted envelope of said source band with the extracted phase of said target band.

In an embodiment, the audio processing device further comprises a pre-processing unit for pre-processing one or more source bands before extracting its/their envelope. Such pre-processing can e.g. involve a summation or weighting or averaging or max/min identification of one or more source bands before a resulting envelope is extracted.

In an embodiment, the audio processing device further comprises a post-processing unit for post-processing one or more extracted target band envelope values. Such post-processing can e.g. comprise smoothing in the time domain (e.g. comprising a weighted sum of values of the signal in a previous time span, e.g. in a number of previous time frames). The post-processing may alternatively or further comprise a linear or non-linear filtering process. A non-linear filtering process can e.g. comprise a differentiation of the signal processing between increasing and decreasing input levels, i.e. e.g. implementing different attack and release times. It may further include the implementation of input level dependent attack and release times.

In an embodiment, the audio processing device is adapted to provide a frequency dependent gain to compensate for a hearing loss of a user.

In an embodiment, the audio processing device comprises a directional microphone system adapted to separate two or more acoustic sources in the local environment of the user wearing the audio processing device. In an embodiment, the directional system is adapted to detect (such as adaptively detect) from which direction a particular part of the microphone signal originates.

In an embodiment, the signal processing unit is adapted for enhancing the input signals and providing a processed output signal.

In an embodiment, the audio processing device comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the audio processing device further comprises other relevant functionality for the application in question, e.g. acoustic feedback suppression, etc.

In an embodiment, the audio processing device comprises a forward path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs.

In an embodiment, the audio processing device comprises an antenna and transceiver circuitry for receiving a direct electric input signal comprising an audio signal (e.g. a frequency compressed audio signal according to a scheme as disclosed by the present disclosure, including extracting the envelope of a source band, and mixing the envelope with the phase of a target band). In an embodiment, the audio processing device comprises an antenna and transceiver circuitry for transmitting an electric signal comprising an audio signal (e.g. a frequency compressed audio signal according to a scheme as disclosed by the present disclosure, including extracting the envelope of a source band, and mixing the envelope with the phase of a target band). In an embodiment, the audio processing device comprises a (possibly standardized) electric interface (e.g. in the form of a connector) for receiving a wired direct electric input signal. In an embodiment, the audio processing device comprises demodulation circuitry for demodulating the received direct electric input to provide a direct electric input signal representing an audio signal. In an embodiment, the audio processing device comprises modulation circuitry for modulating the electric signal representing an (possibly frequency compressed) audio signal to be transmitted.

In an embodiment, the audio processing device comprises an AD-converter for converting an analogue electrical signal to a digitized electrical signal. In an embodiment, the audio processing device comprises a DA-converter for converting a digital electrical signal to an analogue electrical signal. In an embodiment, the sampling rate $f_s$ of the AD-converter is in the range from 5 kHz to 50 kHz.

In an embodiment, the audio processing device comprises a TF-conversion unit for providing a time-frequency representation of a time varying input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, the frequency range $f_{min}$-$f_{max}$ considered by the listening device is split into a number K of frequency bands, where K is e.g. larger than 5, such as larger than 10, such as larger than 50, such as larger than 100, at least some of which are processed individually. In an embodiment, the signal processing unit is adapted to process input signals in a number of different frequency ranges or bands. The frequency bands may be uniform or non-uniform in width (e.g. increasing in width with frequency), cf. e.g. FIG. 1*b*.

In an embodiment, the time to time-frequency conversion unit for providing the electric input signal in a number of frequency bands is a filter bank, such as a complex sub-band analysis filter bank.

In an embodiment, the audio processing device comprises a voice detector for detecting the presence of a human voice in an audio signal (at a given point in time). In an embodiment, the audio processing device comprises a noise detector for detecting a noise signal in an audio signal (at a given point in time). In an embodiment, the audio processing device comprises a frequency analyzer for determining a fundamental frequency and/or one or more formant frequencies of an audio input signal. In an embodiment, the audio processing device is adapted to use information from the voice detector and/or from the noise detector and/or from the frequency analyzer to select an appropriate compression (or expansion) scheme for a current input audio signal.

It is intended that the features of the method described above, in the detailed description of 'mode(s) for carrying out the invention' and in the claims can be combined with the audio processing device, when appropriately substituted by a corresponding structural feature (and vice versa). Embodiments of the device have the same advantages as the corresponding method.

Use of an Audio Processing Device:

Use of an audio processing device as described above, in the detailed description of 'mode(s) for carrying out the invention', and in the claims, is moreover provided by the present application. In an embodiment, use in a communication system is provided, e.g. a system comprising a telephone and/or a listening device, e.g. a hearing instrument or a headset.

An Audio Communication System:

An audio communication system comprising at least one audio processing device as described above, in the detailed description of 'mode(s) for carrying out the invention', and in the claims, is moreover provided by the present application. In an embodiment, the system comprises first and second audio processing devices, at least one being an audio processing device as described above, in the detailed description of 'mode(s) for carrying out the invention'. In an embodiment, the first audio processing device is adapted to compress a selected audio signal (e.g. in that the signal processing unit comprises a frequency transposition scheme for compressing an electric input signal as described by the present disclosure (including extracting the envelope of a source band, and mixing the envelope with the phase of a target band)), the first audio processing device being further adapted to (possibly modulate and) transmit said compressed signal via a transmission channel (e.g. a wired or wireless connection). In an embodiment, the second audio processing device is adapted to receive an audio signal transmitted via a transmission channel from said first audio processing device and to (possibly demodulate and) expand the received audio signal (e.g. in that the signal processing unit comprises a frequency transposition scheme for expanding an electric input signal) to substantively re-establish said selected audio signal. In an embodiment, said first and/or second audio processing devices comprises a transceiver for transmitting a signal to as well as receiving a signal from the other audio processing device (at least the transmitted signal being compressed as described in the present disclosure (including extracting the envelope of a source band, and mixing the envelope with the phase of a target band)). In an embodiment, said audio processing device comprises a device selected from the group of audio devices comprising a telephone, e.g. a cellular telephone, a listening device, e.g. a hearing instrument, a headset, a headphone, an active ear protection device, an audio gateway, an audio delivery device, an entertainment device or a combination thereof.

A Computer-Readable Medium:

A tangible computer-readable medium storing a computer program comprising program code means for causing a data processing system to perform at least some (such as a majority or all) of the steps of the method described above, in the detailed description of 'mode(s) for carrying out the invention' and in the claims, when said computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A Data Processing System:

A data processing system comprising a processor and program code means for causing the processor to perform at least some (such as a majority or all) of the steps of the method described above, in the detailed description of 'mode(s) for carrying out the invention' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

Mode(S) For Carrying Out The Invention

Figure 1A:
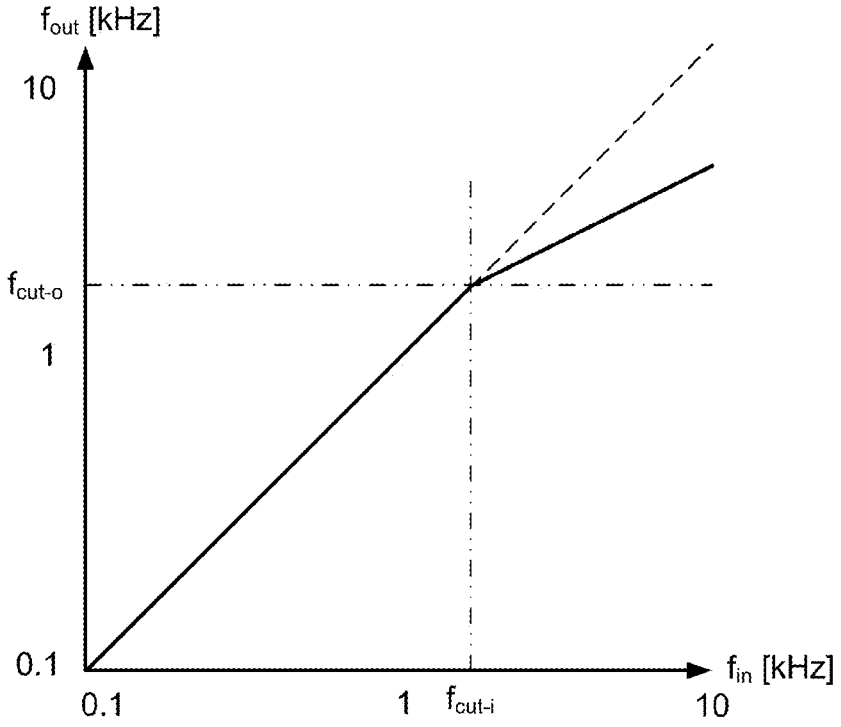
FIG. 1 shows an example of a frequency compression curve illustrating a relation between an input frequency and an output frequency (FIG. 1*a*) as e.g. implemented by a frequency transposition unit, and a time-frequency map of a signal illustrating uniform and non-uniform frequency bands (FIG. 1*b*)

FIG. 1*a* shows a simple frequency compression scheme for an audio signal for converting an input frequency range (here 0.1 kHz to 10 kHz) to an (compressed) output frequency range (here 0.1 kHz to approximately 2.5 kHz). The frequency compression scheme comprises a non-compressed (linear, $f_{in}=f_{out}$) part and a compressed ($f_{in}>f_{out}$) part at frequencies, respectively, below and above a predetermined cut-off frequency, $f_{cut\text{-}i}$ (here approximately 1.5 kHz and equal to $f_{cut\text{-}o}$).

Figure 1B:
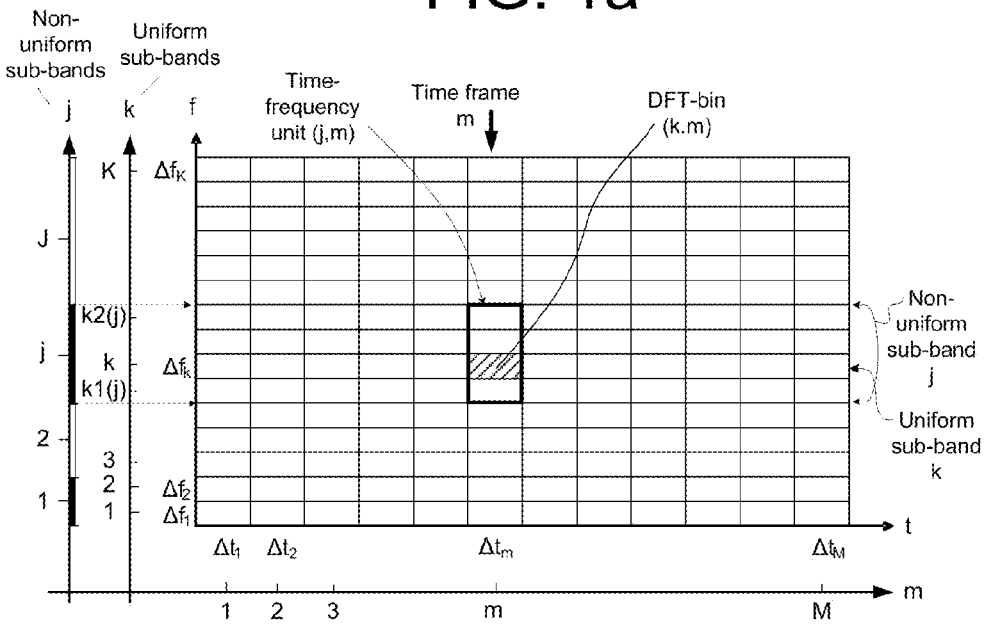

In a particular embodiment, a time-frequency representation s(k,m) of a signal s(n) comprises values of magnitude and phase of the signal in a number of DFT-bins (DFT=Direct Fourier Transform) defined by indices (k,m), where k=1, . . . , K represents a number K of frequency values and m=1, . . . , M represents a number M of time frames, a time frame being defined by a specific time index m and the corresponding K DFT-bins. This corresponds to a uni-form frequency band representation, each band comprising a single value of the signal corresponding to a specific frequency and time, and the frequency units are equidistant (uni-form). This is illustrated in FIG. 1*b* and may e.g. be the result of a discrete Fourier transform of a digitized signal arranged in time frames, each time frame comprising a number of digital time samples $s_q$ of the input signal (amplitude) at consecutive points in time $t_q=q*(1/f_s)$, q is a sample index, e.g. an integer q=1, 2, . . . indicating a sample number, and $f_s$ is a sampling rate of an analogue to digital converter. Such arrangement can e.g. alternatively be implemented by a uniform filter bank. In an embodiment, the sampling rate is in the range from 10 kHz to 40 kHz, e.g. larger than 15 kHz or larger than 20 kHz.

In a particular embodiment, a number J of non-uniform frequency sub-bands with sub-band indices j=1, 2, . . . , J is defined, each sub-band comprising one or more DFT-bins, the j'th sub-band e.g. comprising DFT-bins with lower and upper indices k1(*j*) and k2(*j*), respectively, defining lower and upper cut-off frequencies of the j'th sub-band, respectively, a specific time-frequency unit (j,m) being defined by a specific time index m and said DFT-bin indices k1(*j*)-k2(*j*), cf. e.g. FIG. 1*b*. In the arrangement of non-uniform frequency sub-bands shown in FIG. 1*b*, a sub-band may contain more than one frequency unit (DFT-bin). In another embodiment, each non-uniform frequency sub-band comprises only one (complex) value of the signal (reflecting non-uniform frequency units). Such arrangement can e.g. be implemented by a non-uniform filter bank.

Figure 2A:
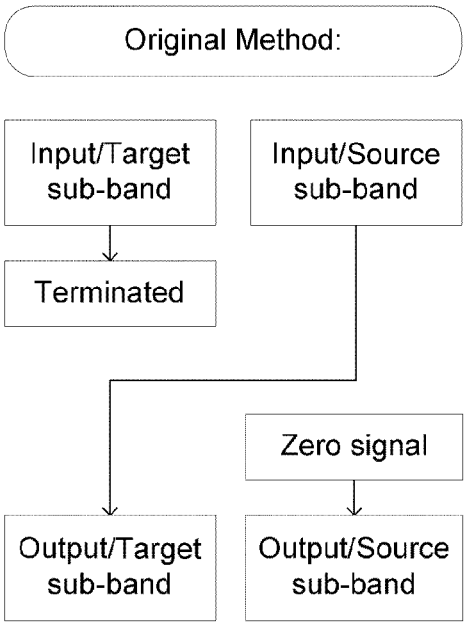
FIG. 2 shows a prior art frequency transposition method (FIG. 2*a*) and first and second embodiments of a frequency transposition method according to the present disclosure (FIG. 2*b*, 2*c*)
Figure 2B:
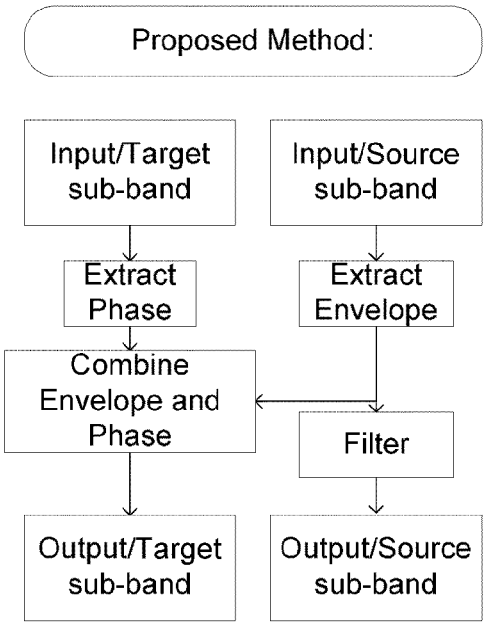
Figure 2C:
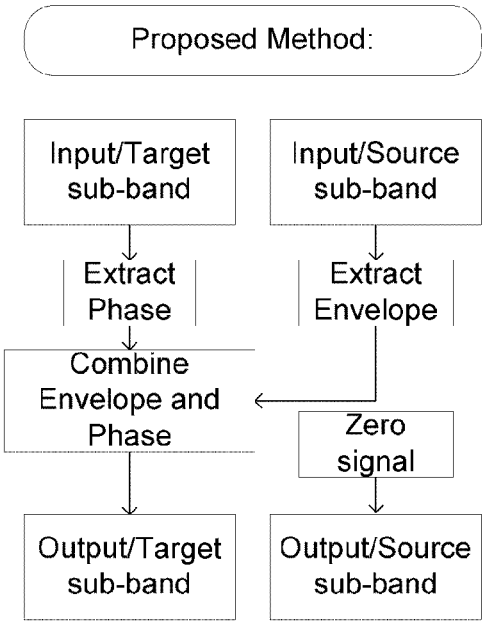

In prior art solutions both amplitude and phase information are moved. The present inventors propose to move the instantaneous envelope of one or more source sub-bands to one or more corresponding target sub-bands, while keeping the fine structure (phase information) of the target sub-bands (cf. FIG. 2). FIG. 2 shows a prior art frequency transposition method (FIG. 2*a*) and first and second embodiments of a frequency transposition method according to the present disclosure (FIG. 2*b*, 2*c*). In the prior art method schematically illustrated in FIG. 2*a* a source sub-band is selected and its (complex) contents transposed to a target sub-band as indicated by the arrow from the box Input/Source sub-band to the box Output/Target sub-band. The contents of the original (input) target sub-band (cf. box Input/Target sub-band) and the original (output) source sub-band (cf. box Output/Source sub-band) are not used as indicated by the arrows ending in and originating from, respectively, the boxes termed Terminated and Zero signal in FIG. 2*a*.

FIG. 2*b* schematically illustrates a frequency transposition method according to the present disclosure, wherein a source sub-band is selected (cf. box Input/Source sub-band) and its envelope (magnitude) extracted (cf. box Extract Envelope) and transposed to a (output) target sub-band, and combined with the phase extracted from (cf. box Extract Phase) a selected target band (cf. box Input/Target sub-band), as indicated by the arrow from the box Combine Envelope and Phase to the box Output/Target sub-band. The contents of the original (output) source sub-bands (cf. box Output/Source sub-band) are filtered (cf. block Filter), e.g. attenuated according to a predefined scheme (e.g. linearly of logarithmically) from the value of the upper most target band (cf. schematic examples thereof in FIG. 6-8).

FIG. 2*c* schematically illustrates a frequency transposition method as shown in FIG. 2*b* wherein Filtering step to provide the Output/Source sub-bands is implemented as a zero-filter (forcing the output source bands to zero) as indicated by the arrow originating from the box termed Zero signal and ending in box Output/Source sub-band in FIG. 2*c*.

In the simplest implementation, the instantaneous amplitude is moved, but more elaborate envelope extraction methods are also possible. Another possibility is NOT to maintain the phase information in the sub-band, but to replace it with band-limited noise.

FIG. 3 shows various frequency compression/expansion schemes that may be used in connection with the present invention.

Figure 3A:
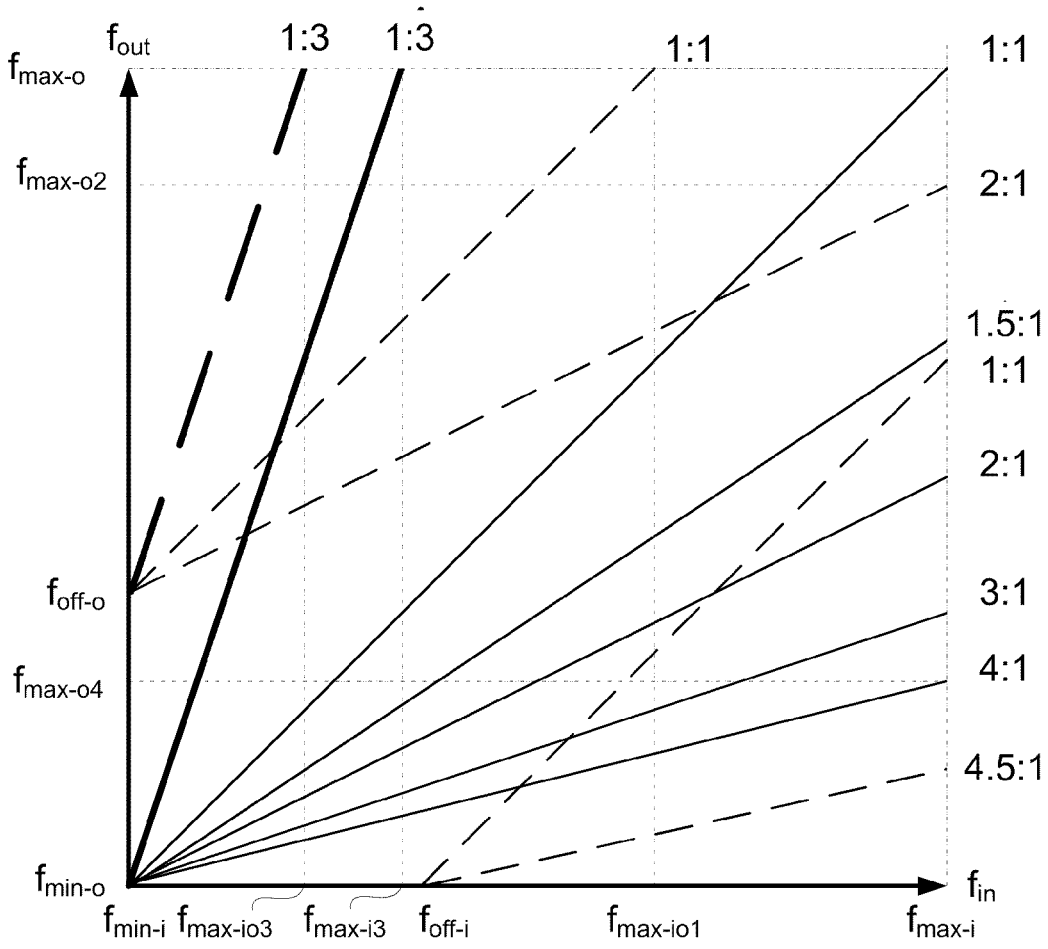
FIG. 3 shows various frequency compression/expansion schemes that may be used in connection with the present invention.

FIG. 3*a* illustrates a number of linear compression and expansion schemes of input frequencies $f_{in}$ to output frequencies $f_{out}$ with integer (e.g. 2:1, 3:1, 4:1, 1:3) or non-integer (e.g. 1.5:1, 4.5:1) compression and expansion ratios, respectively. The thin solid lines represent a mapping of the full input frequency range $\Delta f_{in}=f_{max-i}-f_{min-i}$ to a narrower (compression) output frequency range $\Delta f_{out}=f_{max-ox}-f_{min-o}$ (where $f_{max-ox}$ is the maximum output frequency for a given compression scheme, $f_{max-o4}$ indicating e.g. the maximum output frequency for the 4:1 compression scheme. In an embodiment, the maximum output frequency $f_{max-ox}$ is equal to the critical frequency $f_{crit}$ (cf. e.g. FIG. 3*b* and FIG. 5-8). The bold solid line (marked 1:3) represent a mapping of the partial input frequency range $\Delta f_{in}=f_{max-i3}=f_{max-i3}-f_{min-i}$ to a wider (expanded) output frequency range, here the full output range $\Delta f_{out}=f_{max-o}-f_{min-o}$. The dashed lines represent partial mappings of the input frequency range to the output frequency range. The dashed lines originating on the input frequency axis $f_{in}$ at an off-set frequency $f_{off-i}$ maps only the input frequencies above the off-set frequency $f_{off-i}$ (and below the maximum input frequency $f_{max-i}$ considered) to a (possibly compressed or expanded) output frequency range (with exemplary compression ratios 1:1 and 4.5:1). The input frequency range between the minimum input frequency $f_{min-i}$ and the off-set frequency $f_{off-i}$ NOT considered can e.g. be a frequency range containing noise or otherwise not being of interest for the user. The dashed lines originating on the output frequency axis $f_{out}$ at an off-set frequency $f_{off-o}$ maps the input frequencies only to output frequencies above the off-set frequency $f_{off-o}$ (and below the maximum output frequency $f_{max-ox}$ considered, e.g. $f_{max-o2}$). The full input frequency range can be compressed (thin dashed line denoted 2:1) with an appropriate compression ratio (above a minimum ratio) to the partial output frequency range. The bold dashed line (marked 1:3) represent a mapping of the partial input frequency range $\Delta f_{in}=f_{max-io3}-f_{min-i}$ to a wider (expanded) output frequency range, here the partial output range $\Delta f_{out}=f_{max-o}-f_{off-o}$. The output frequency range between the minimum output frequency $f_{min-o}$ and the off-set frequency $f_{off-o}$ NOT considered can e.g. be a frequency range where the user has no hearing ability, or a frequency range not being considered by a transmission channel.

The frequency expansion schemes shown in FIG. 3*a* can e.g. be combined with corresponding frequency compression schemes, e.g. in connection with a transmission of a frequency compressed audio signal (e.g. according to compression line 3:1) from a first device (e.g. an audio delivery device or a communications device) to a second device (e.g. a communication device and/or a listening device, e.g. a hearing instrument), where the received, compressed signal is correspondingly expanded (e.g. according to expansion line 1:3) to (substantially) 'regenerate' the original signal. Thereby frequency cues located above the upper limit of the bandwidth of the transmission channel can be transferred from the first to the second device. In an embodiment, an improved sound perception (and/or an improved speech intelligibility) can thereby be achieved. In an embodiment, the transmission from the first to the second device is via a wired connection, e.g. according to telephone standard channel. In an embodiment, the transmission from the first to the second device is via a wireless link, e.g. according to proprietary scheme or a standardized protocol. In an embodiment, the wireless link is based on near-filed communication, e.g. using an inductive coupling between respective coils in the first and second device.

Typically integer compression ratios are used. Non-integer compression ratios can, however, alternatively be used.

Alternatively to a fixed scheme (where e.g. every second or every third frequency band is transposed in a given order, as exemplified in FIG. 6) a strategy can be pursued wherein peaks and valleys in the magnitude spectrum of the source bands are identified (e.g. to ensure that the extreme values of the signal are included in the transposed (target) signal). An example of this is illustrated in FIG. 7. In such scheme the source bands may not be selected according to a specific order, but an overall frequency compression ratio may nevertheless be applied.

In the present context, a compression ratio may be defined as $\Delta f_{source}/\Delta f_{target}$, where $\Delta f_{source}$ is the input frequency range covered by the (pool of) source band(s) and $\Delta f_{target}$ is the output frequency range covered by the target band(s) onto which the source band(s) are mapped. In an embodiment, a compression ratio can be defined relative to a critical frequency $f_{crit}$ (e.g. defining a frequency above which a user has a significant hearing impairment) and a cut-off $f_{cut}$ frequency above which a frequency compression is performed. With reference to FIG. 3*c*, a compression ratio for the compression scheme defined by the compression curves (e.g. linear 4:1 or 3:1 curves) may be expressed as $(f_{max-i}-f_{cut-i})/(f_{crit}-f_{cut-o})$.

Figure 3B:
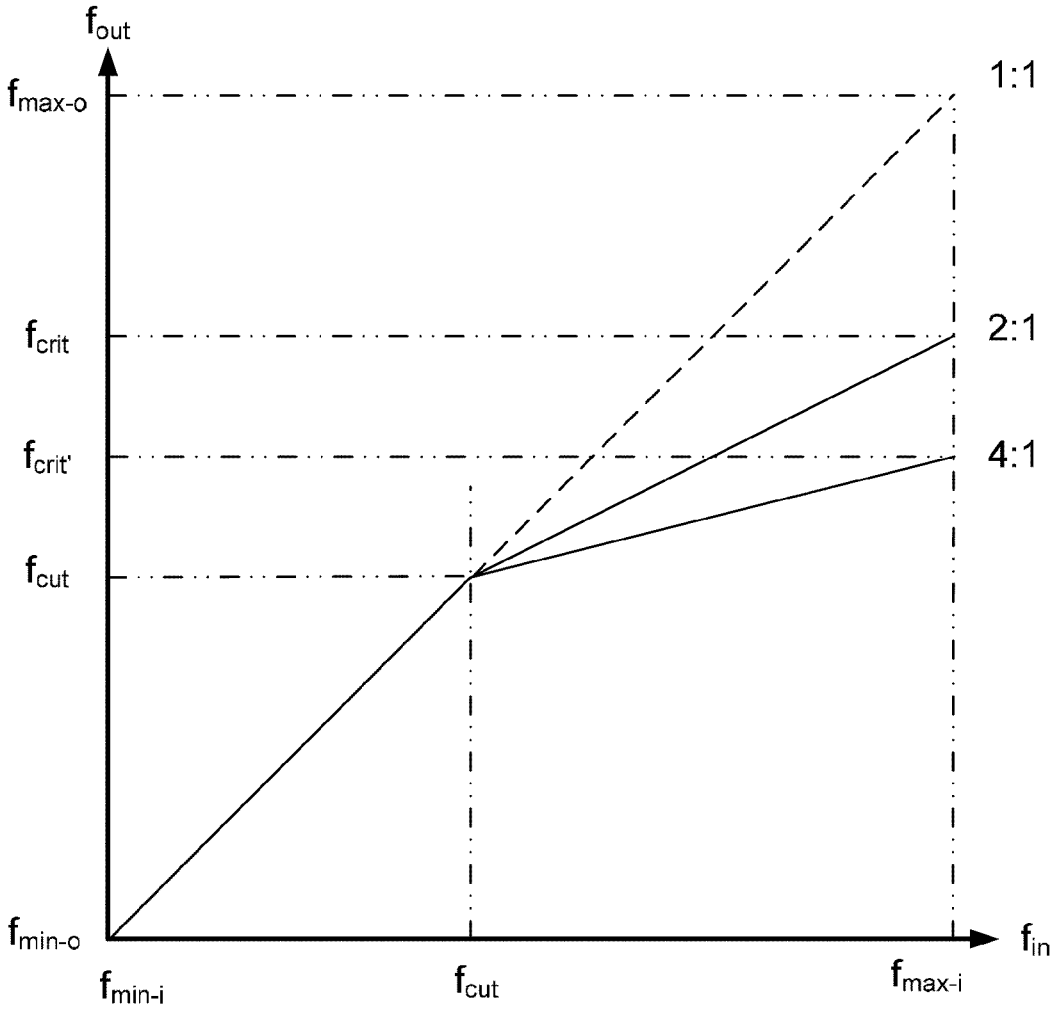
Figure 3C:
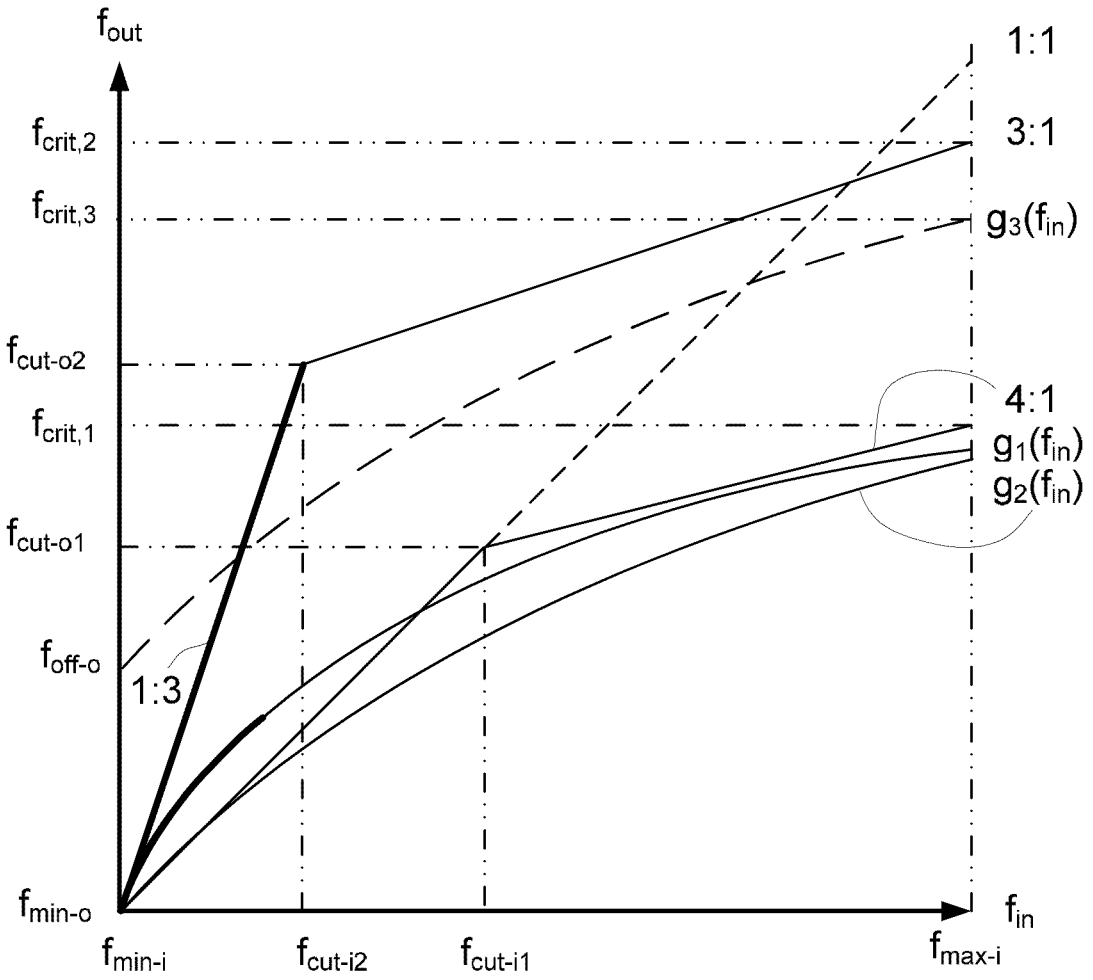

FIG. 3*b* shows two different compression curves with integer compression ratios 2:1 and 4:1, respectively. The input frequency ($f_{in}$) range from $f_{min-i}$ to $f_{cut}$ is mapped directly (without compression or expansion) to a corresponding output frequency ($f_{out}$) range $f_{min-o}$ to $f_{cut}$. In an embodiment, $f_{min-i}=f_{min-o}$ and (thus) $f_{cut}=f_{cut-o}=f_{cut}$, as indicated in FIG. 3*b*. This need not be the case however. The input frequency range from $f_{cut}$ to $f_{max-i}$ is compressed to an output frequency range from $f_{cut}$ to $f_{crit}$ (2:1 compression) or to $f_{crit'}$ (4:1 compression), respectively.

FIG. 3*c* shows a number of different expansion/compression curves which may be used with the present method. Expansion is indicated with bold curves.

The curve denoted 1:3 and 3:1 represents an expansion (1:3) of the input frequency range from $f_{min-i}$ to $f_{cut-i2}$ to the output frequency range $f_{min-o}$ to $f_{cut-o2}$ AND a compression (3:1) of the input frequency range from $f_{cut-i2}$ to $f_{max-i}$ to the output frequency range from $f_{cut-o2}$ to $f_{crit,2}$.

The linear curve denoted 1:1 and 4:1 represents a one-to-one mapping of the input frequency range from $f_{min-i}$ to $f_{cut-i1}$ to the output frequency range from $f_{min-o}$ to $f_{out-o1}$ and a compression (4:1) of the input frequency range from $f_{cut-i1}$ to $f_{max-i}$ to the output frequency range from $f_{cut-o1}$ to $f_{crit,1}$. Curves $g_1(f_{in})$ and $g_2(f_{in})$ each maps the input range from $f_{min-i}$ to $f_{max-i}$ to the output frequency range from $f_{min-o}$ to $f_{crit,1}$ similarly to the piecewise linear compression curve denoted 1:1 and 4:1, but in a non-linear fashion (e.g. following a logarithmic or power function, at least over a part of the frequency range). The curve $g_1(f_{in})$ has an initial part (at low frequencies) where expansion is performed (as indicated by the bold part of the curve), whereas the rest of the curve implements compression. The curve $g_2(f_{in})$, on the other hand, implements compression over the full input frequency range.

The dashed curve $g_3(f_{in})$ implements a non-linear compression scheme initiating at output frequency $f_{off-o}$ (e.g. below which the user has no or degrade hearing ability) and maps the input frequency range from $f_{min-i}$ to $f_{max-i}$ to the output frequency range from $f_{off-o}$ to $f_{crit,3}$.

In embodiments of the present disclosure, a sub-band filter bank providing real or complex valued sub-band signals is used to move the source sub-band envelope to the target sub-band envelope according to the chosen compression scheme. The output signal is obtained by reconstructing a full-band signal from the sub-band signals using a synthesis filter bank. When no down-sampling is used in the analysis filter bank, the sub-band signals and a simple addition of the sub-band signals may be sufficient to reconstruct the output signal. Otherwise a synthesis filter bank with up-sampling can be used.

Figure 4A:
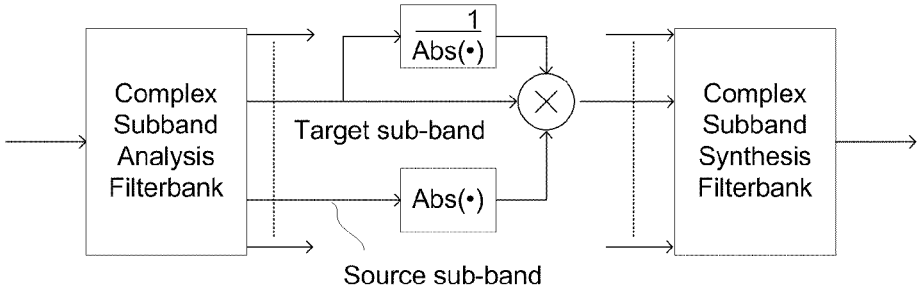
FIG. 4 shows examples of implementations of a frequency transposition method as illustrated in FIG. 2*b* or 2*c*, FIG. 4*a* using a complex sub-band filter bank, FIG. 4*b* using a real sub-band filter bank, FIG. 4*c* using a complex sub-band filter bank and pre-processing of the source signal before the envelope extraction and post-processing of the extracted envelope.
Figure 4B:
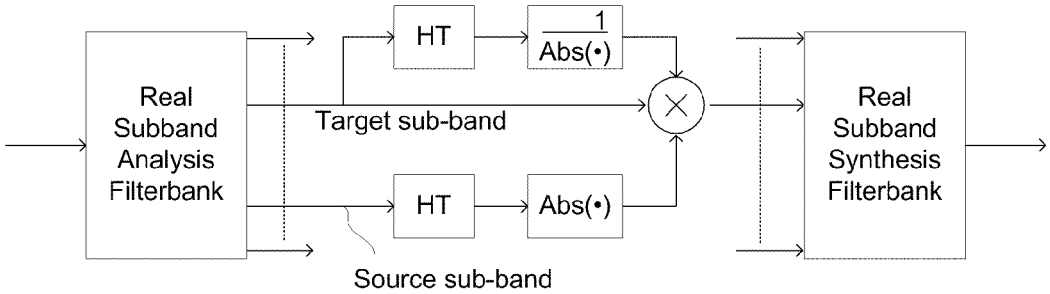
Figure 4C:
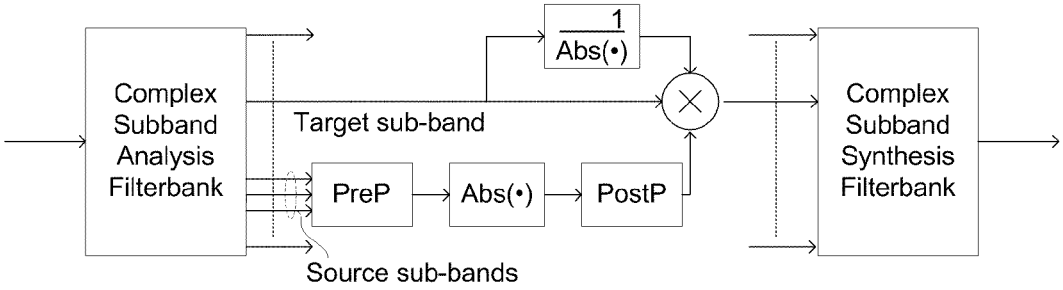

FIG. 4 shows examples of implementations of a frequency transposition method as illustrated in FIG. 2*b* or 2*c*, FIG. 4*a* using a complex sub-band filter bank, FIG. 4*b* using a real sub-band filter bank, FIG. 4*c* using a complex sub-band filter bank and pre-processing of the source signal before the envelope extraction and post-processing of the extracted envelope. The envelope can be extracted by using an absolute value operation on complex sub-band signals (as illustrated in FIGS. 4*a* and 4*c*). The Complex Subband Analysis Filterbank unit provides source band signals $s_n=A_{sn}e^{i\phi sn}$ in a number of source bands (n=1, 2, . . . , $N_s$) and target band signals $t_p=A_{tp}e^{i\phi tp}$) in a number of target bands (p=1, 2, . . . , $N_t$). The units denoted 1/Abs(•)(in FIG. 4) provide as an output the inverse of the absolute value (magnitude) of the input signal (e.g. $1/A_{tp}$). In an embodiment, the 1/Abs(•)-unit includes a post-processing scheme, e.g. a non-linear, input dependent post processing, e.g. to ensure that if a current Abs(•)-value is below a specific low value (indicating that the frequency content of the signal in that frequency band is close to zero), the unit outputs a zero-value of 1/Abs(•) for that band (whereby the phase of the signal is discarded). The unit denoted Abs(•) provides as an output the absolute value of the input signal (e.g. the magnitude $A_{sn}$). The multiplication unit (X) provides as an output the product of the three input signals (e.g. $1/A_{tp}$,$A_{sn}$and $A_{tp}e^{i\phi tp}$), providing the desired output signal $A_{sn}e^{i\phi tp}$. If the sub-band signals are real-valued, a Hilbert transform (cf. HT-units in FIG. 4*b*) is used prior to the absolute value operation (as illustrated in FIG. 4*b*). FIG. 4*c* shows an embodiment (based on the embodiment of FIG.4*a* (but may likewise be incorporated into the embodiment of FIG. 4*b*)), wherein an optional pre-processing of one or more source sub-bands is performed before the envelope value to be used in the target band is extracted. The pre-processing can e.g. comprise filtering, and/or summation of two or more signals (e.g. neighboring channels), e.g. including averaging and/or min/max evaluation. The pre-processing can e.g. implement the chosen strategy for selection of source bands (cf. examples in FIG. 6-8). Otherwise, the sub-band analysis filter bank can implement such strategy, optionally controlled by a signal processing unit. Further, an optional post-processing of the envelope value to be used in the target band is performed. The post-processing can e.g. comprise filtering (e.g. smoothing in time), and/or non-linear, e.g. input level dependent, filtering. A complex sub-band analysis filter bank as used in the embodiments of FIGS. 4*a* and 4*c* can be implemented in variety of ways, e.g. as a uniform DFT filter bank (cf. e.g. [Vaidyanathan, 1993], p. 116) or using a standard overlap-add (OLA) method, e.g. a windowed overlap-add (WOLA) method.

In an embodiment, a complex filter bank is used for separating a sub-band into instantaneous amplitude and phase. A uniform-DFT filter bank is an example of such a complex sub-band filter bank.

Figure 5:
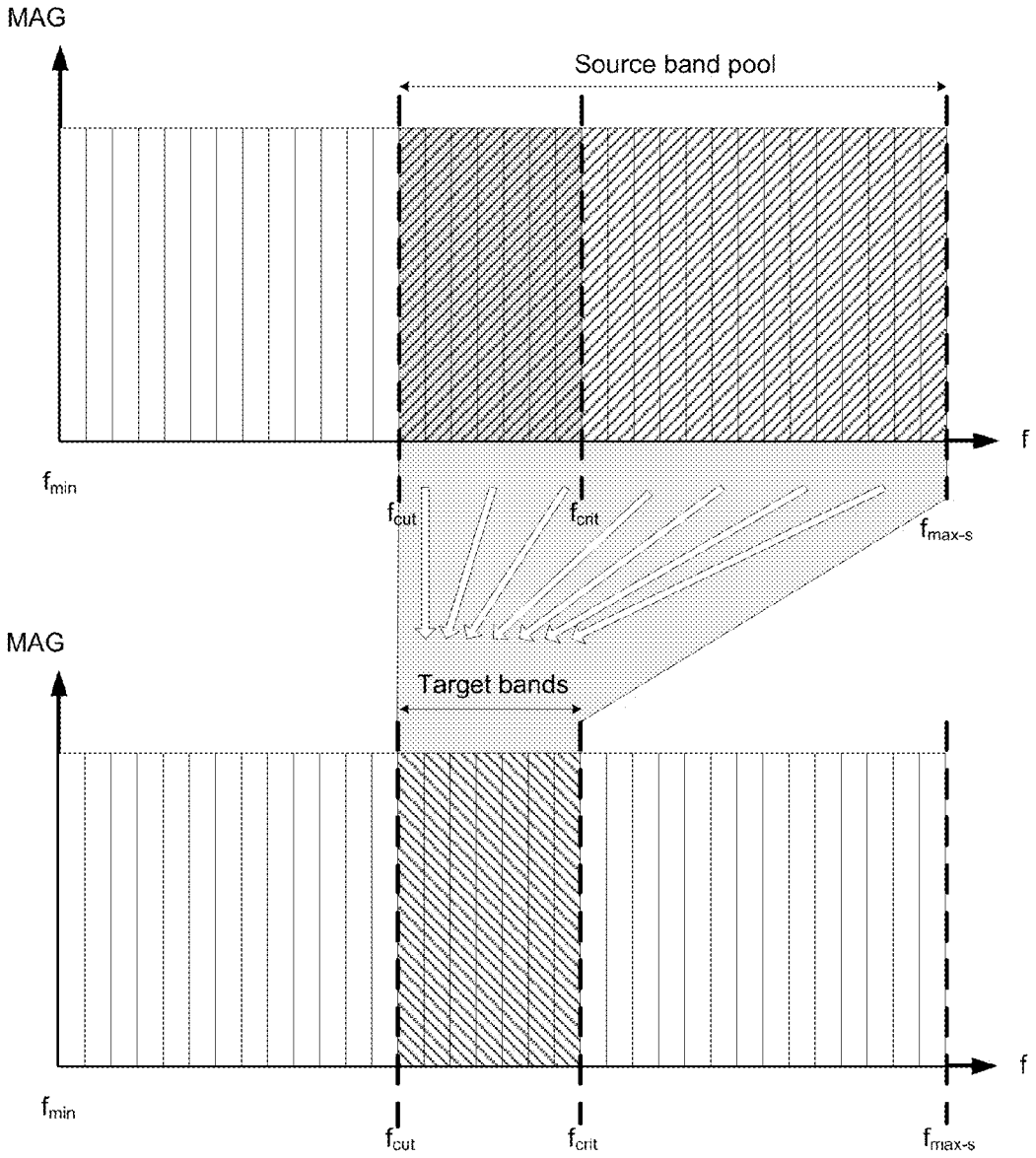
FIG. 5 shows a schematic representation of the magnitude (MAG) of an audio signal divided in a number of uniform frequency bands in a given time unit, illustrating the relative location of source and target bands along the frequency axis f between a minimum frequency $f_{min}$ and a maximum source band frequency $f_{max\text{-}s}$.

FIG. 5 shows a schematic representation of the magnitude (MAG) of an audio signal divided in a number of uniform frequency bands in a given time unit, illustrating the relative location of source and target bands along the frequency axis f between a minimum frequency $f_{min}$ and a maximum source band frequency $f_{max-s}$. The top graph shows that a pool of source bands are located between a cut-off frequency $f_{cut}$ and a maximum source band frequency $f_{max-s}$. The bottom graph shows that target bands are located between a cut-off frequency $f_{cut}$ and a critical frequency $f_{crit}$. As indicated by the arrows connecting the top and bottom parts of FIG. 5 the magnitude (MAG) of a number $N_s$ of source bands are mapped to constitute the magnitude of a number $N_t$ of target bands (here a compression scheme ($N_t<N_s$) with a compression ratio $N_t/N_s$ is indicated).

Figure 6A:
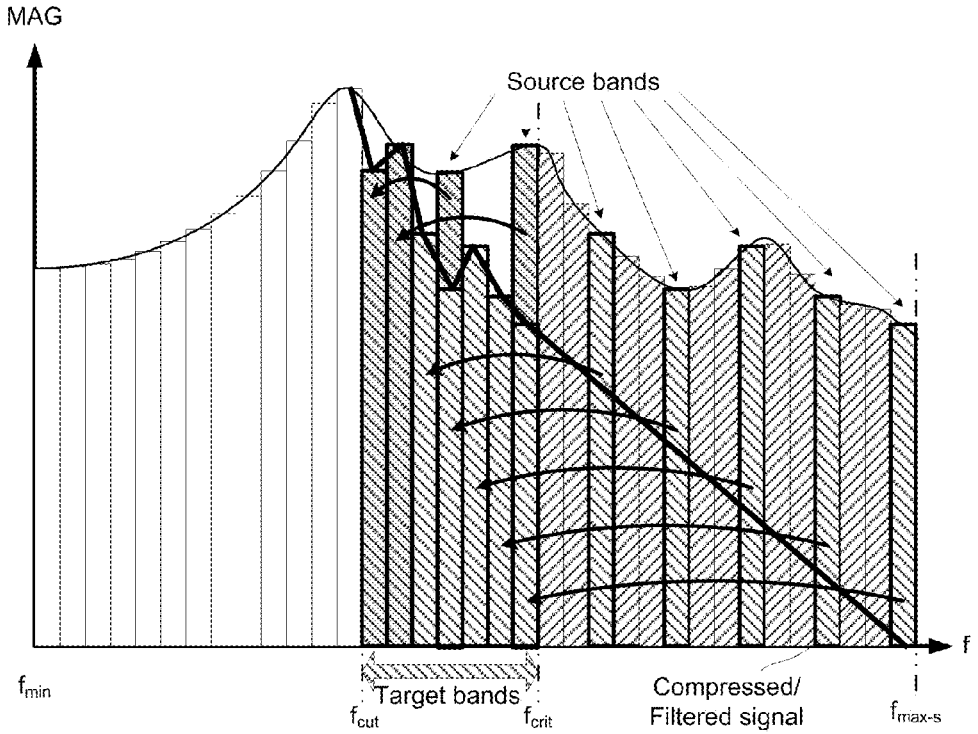
FIG. 6 shows a first frequency compression scheme as proposed by the present application applied to an audio signal in a given time unit (or to an average of a number of time units), FIG. 6*a* schematically illustrating the magnitude (MAG) of the original and transposed signal and FIG. 6*b* schematically illustrating the phase (PHA) of the original and transposed signal.
Figure 6B:
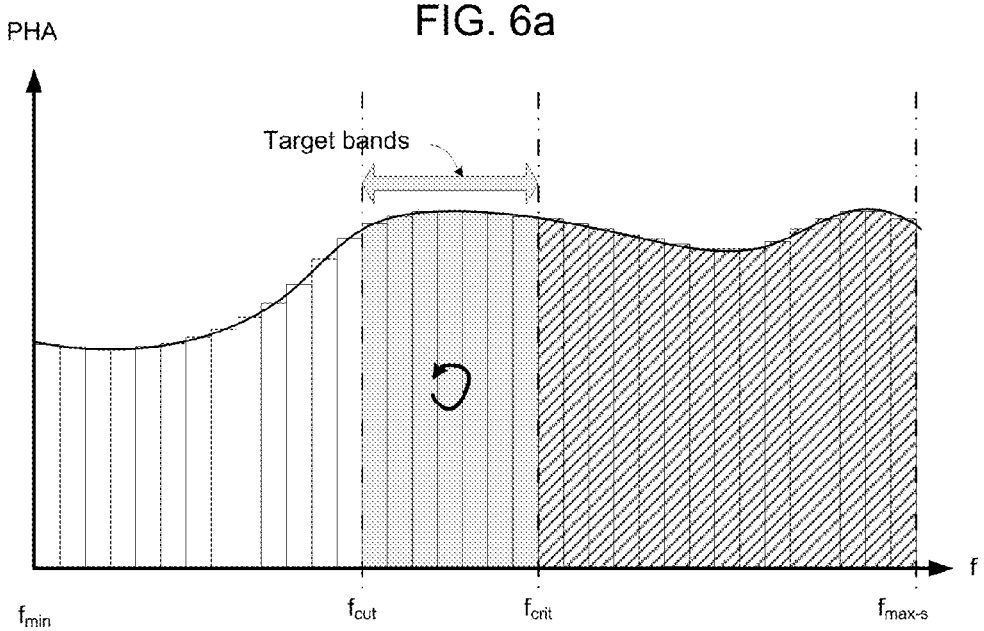

FIG. 6 shows a first frequency compression scheme as proposed by the present application applied to an audio signal in a given time unit (or to an average of a number of time units), FIG. 6*a* schematically illustrating the magnitude (MAG) of the original and transposed signal and FIG. 6*b* schematically illustrating the phase (PHA) of the original and transposed signal. FIG. 6 illustrates a 3:1 compression scheme of the magnitudes of the (source) frequency bands above a cut-off frequency $f_{cut}$ (and below a maximum source band frequency $f_{max-s}$) to t target frequency bands between the cut-off frequency $f_{cut}$ and a critical frequency $f_{crit}$. The source bands whose magnitudes are transposed to a target band are identified by solid arrows (from source to target band). The bold curve connecting the magnitude values of the target bands is continued over the source band (denoted Compressed/Filtered signal), indicating an example of a filtering (attenuation) of the remaining source bands (cf. FIG. 2*b*). The phases of the target bands are left unaltered (i.e. the transposed magnitude values are combined with the original phases of the target bands) as indicated by the circular arrow in FIG. 6*b*. The magnitudes and phases of the frequency bands below $f_{cut}$ are left unaltered.

Figure 7A:
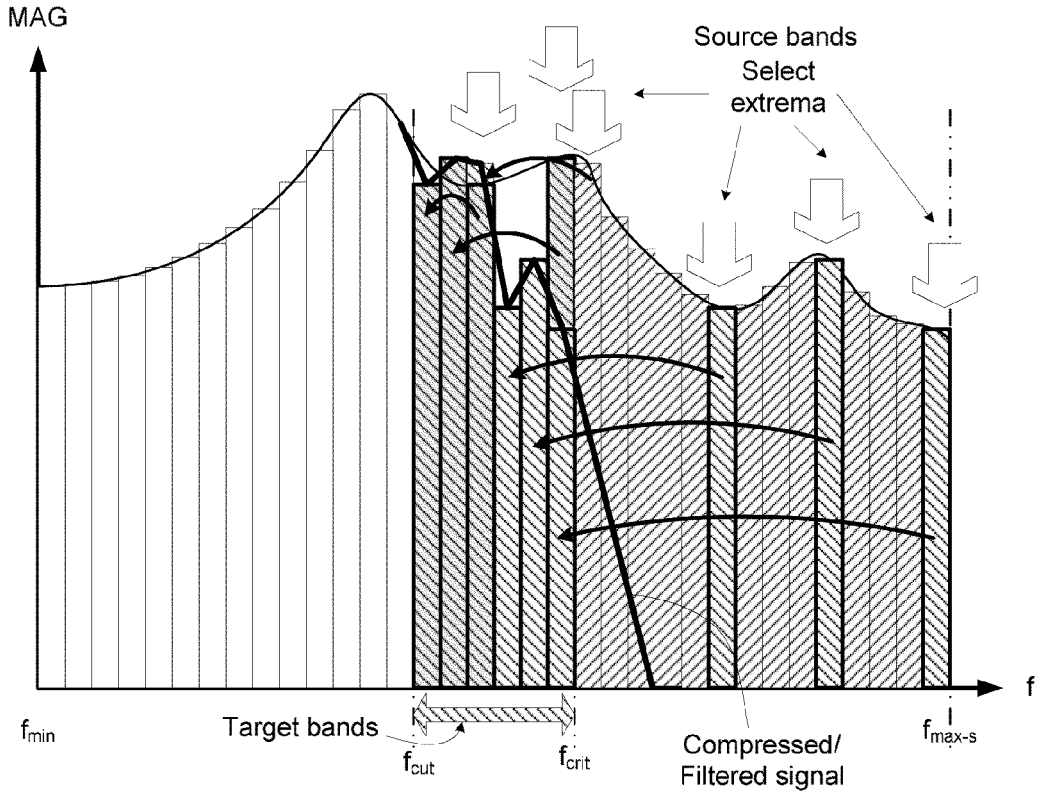
FIG. 7 shows a second frequency compression scheme as proposed by the present application applied to an audio signal at a given time, FIG. 7*a* schematically illustrating the magnitude (MAG) of the original and transposed signal and FIG. 7*b* schematically illustrating the phase (PHA) of the original and transposed signal.
Figure 7B:
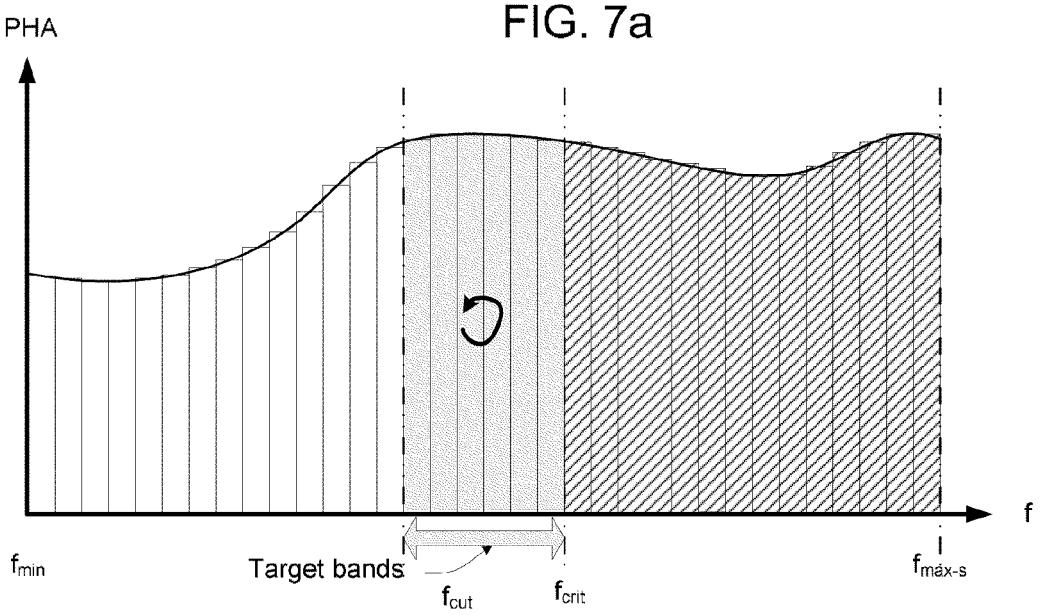

FIG. 7 shows a second frequency compression scheme as proposed by the present application applied to an audio signal at a given time, FIG. 7*a* schematically illustrating the magnitude (MAG) of the original and transposed signal and FIG. 7*b* schematically illustrating the phase (PHA) of the original and transposed signal. FIG. 7 is similar to FIG. 6, only representing a different compression scheme, namely identifying the extrema of the source bands (as indicated by the large arrows denoted Source bands. Select extrema). In the scheme illustrated in FIG. 7, the extrema are found individually for the group of source bands locate between $f_{cut}$ and $f_{crit}$ and for the group of source bands located between $f_{crit}$ and $f_{max-s}$, respectively. Other similar max/min-strategies could alternatively be implemented, e.g. a min/max-strategy that ensures a predefined compression ratio.

Figure 8:
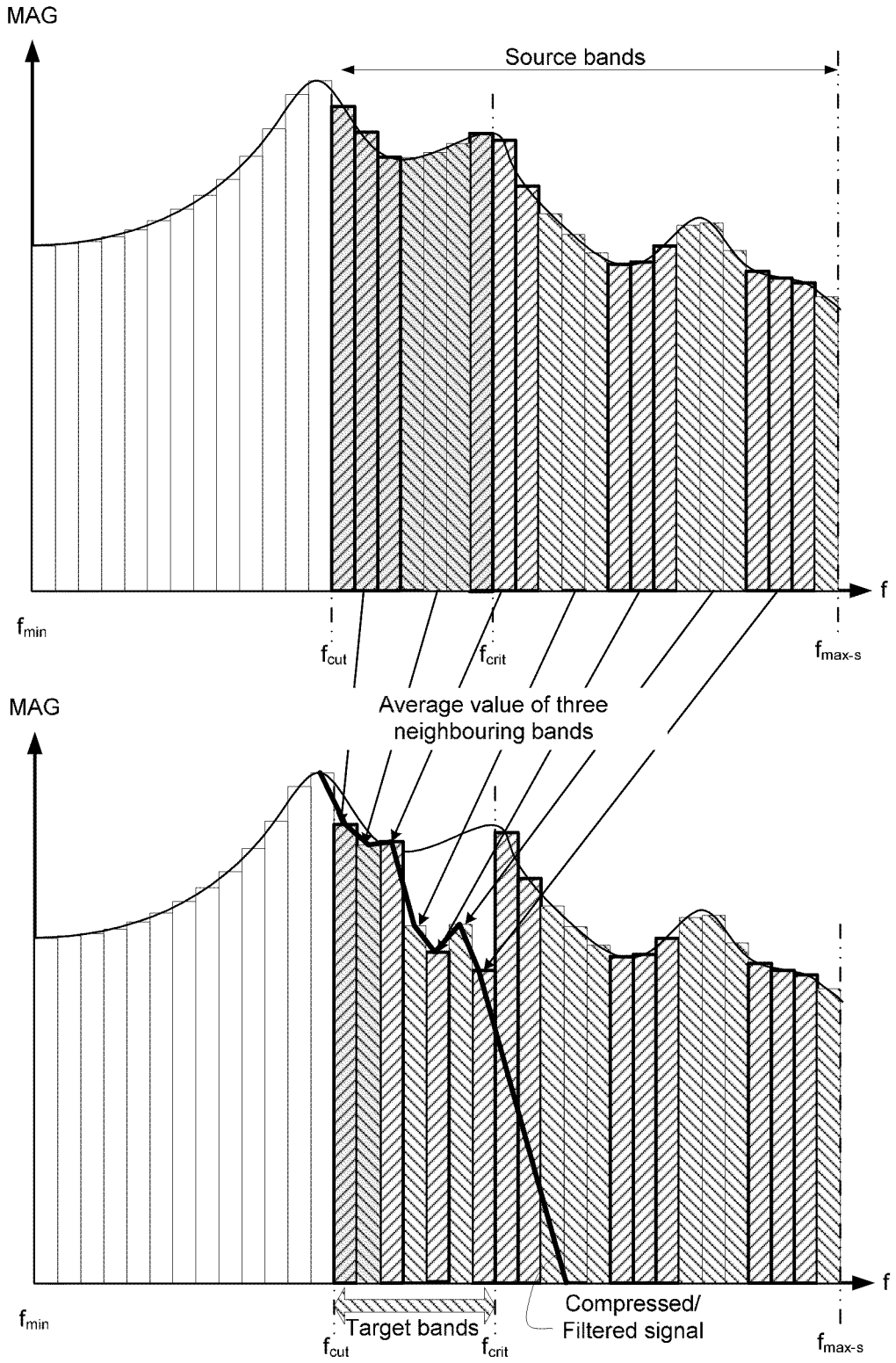
FIG. 8 shows a third frequency compression scheme as proposed by the present application applied to an audio signal at a given time, schematically illustrating the magnitude (MAG) of the original and transposed signal.

FIG. 8 shows a third frequency compression scheme as proposed by the present application applied to an audio signal at a given time, schematically illustrating the magnitude (MAG) of the source bands (upper curve) and the transposed target bands (lower curve). The compression strategy of FIG. 8 comprises the averaging of the magnitudes of 3 neighbouring source bands (each group of 3 being indicated by different hatching). The transposition of source to target bands is indicated by arrows connecting the upper with the lower graph (and denoted by the text 'Average value of three neighbouring bands' indicating the source band selection strategy (or preprocessing strategy as discussed in connection with FIG. 4*c*). The phase relationships of the source and target bands are unaltered (as e.g. illustrated in FIGS. 6*b* and 7*b*).

The expected user-benefit of the transposition schemes of the present disclosure is the same as for conventional frequency compression, i.e. mainly audibility and speech intelligibility. The present scheme may, however, lead to significantly better sound quality and possibly even further improvements in terms of speech intelligibility. It could further allow using this kind of frequency lowering principles for more users, in particular users with milder hearing loss. The method is not limited to frequency compression only but can be used for any kind of frequency lowering principle [Simpson; 2009] and may even involve frequency expansion.

Figure 9A:
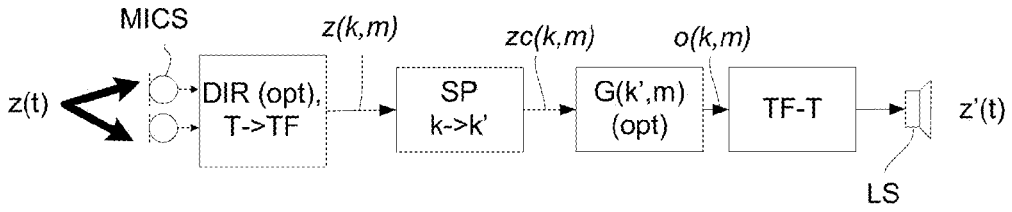
FIG. 9 shows various embodiments of audio processing devices according to the present application, FIG. 9*a* showing an audio processing device comprising a microphone system for picking up a sound signal from the environment, FIG. 9*b* showing an audio processing device comprising a wireless receiver for receiving an audio signal from another device, and FIG. 9*c* showing an audio communication system comprising a listening device and an audio gateway device forming an intermediate relay station between the listening device and an audio delivery device, e.g. a cellular telephone.
Figure 9B:
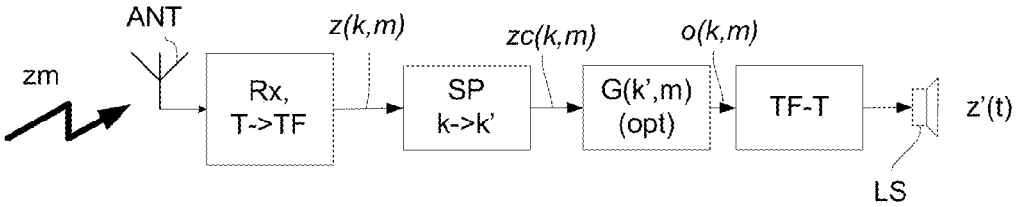

FIGS. 9*a* and 9*b* illustrate a listening device comprising an input transducer for providing a time varying audio input signal, a time to time-frequency conversion unit T-TF for converting the time varying audio input signal to a signal in the time-frequency domain, a signal processing unit SP for imposing a compression and/or expansion scheme (k->k) as described in the present disclosure, an optional gain unit G(k',m), for applying a frequency dependent gain (e.g. according to a user's hearing impairment) and possibly performing other signal processing functions, e.g. noise reduction, feedback cancellation, etc., a time-frequency to time conversion unit TF->T for converting a signal in the time frequency domain to a time varying audio output signal, and a speaker unit LS for converting the time varying audio output signal to an output sound z'(t) for being presented to a user. In the embodiment of FIG. 9*a*, the input transducer comprises a microphone system MICS for picking up a time varying input sound signal z(t) and converting it to an electric time varying audio input signal. In the embodiment of FIG. 9*b*, the input transducer comprises a wireless receiver ANT and Rx-unit for receiving a wirelessly transmitted signal zm and for extracting an electric time varying audio input sound signal.

In an embodiment, the listening device comprises both types of input transducers (possibly further or alternatively including a direct wired electric audio input), wherein one or more of the inputs may be chosen via a selector or mixer unit. In an embodiment, an appropriate compression or expansion scheme may be selected (in that e.g. the signal processor is configured to automatically select an appropriate scheme) depending on the type of input transducer from which an input signal is selected.

In an embodiment, an appropriate compression or expansion scheme may be selected (in that e.g. the signal processor is configured to automatically select an appropriate scheme) depending on the type of input signal received by the device in question (type being e.g. speech, music, noise, speech being e.g. male or female or child speech), e.g. based on various detectors or analyzing units. In an embodiment, the audio processing device comprises a voice detector for detecting the presence of a human voice in an audio signal. In an embodiment, the audio processing device comprises a frequency analyzer for determining one or more formant frequencies of an audio input signal, e.g. a fundamental frequency (cf. e.g. EP 2 081 405 A1 and references therein). In an embodiment, the audio processing device comprises a noise detector for detecting the presence of noise in an audio signal.

Figure 9C:
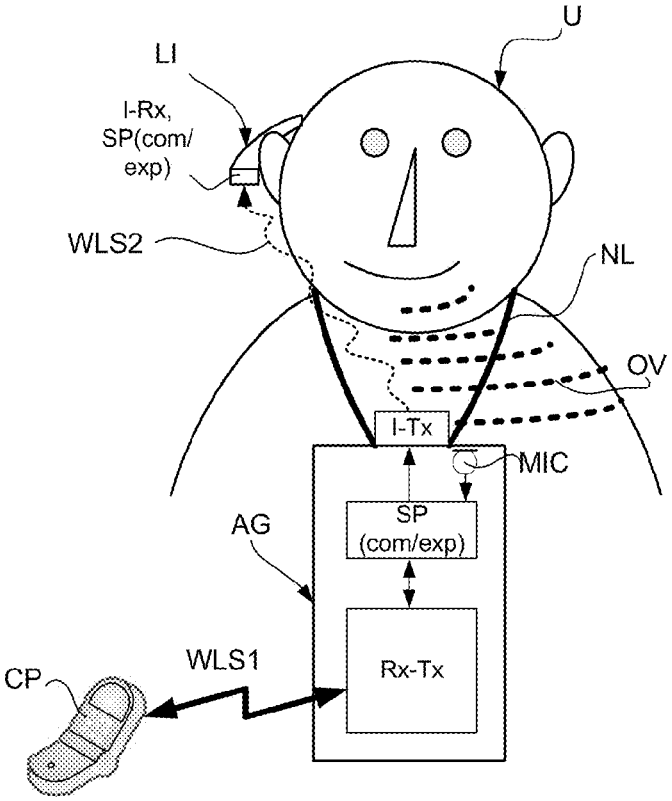

FIG. 9*c* illustrates an audio communication system comprising a first audio processing device in the form of a listening instrument LI and a second audio processing device in the form of a body worn device, here a neck worn audio gateway device AG for selecting one of a number of received audio signals and forwarding the selected audio signal to the listening instrument LI. The two devices are adapted to communicate wirelessly with each other via a wired or (as shown here) a wireless link WLS2. The audio gateway device AG is e.g. adapted to be worn around the neck of a user U in neck strap NL. The audio gateway device AG comprises a signal processing unit SP, a microphone MIC and at least one receiver Rx-Tx for receiving an audio signal from an audio delivery device. The audio gateway device comprises e.g. antenna and transceiver circuitry (cf. link WLS1 and Rx-Tx unit in FIG. 9*c*) for receiving and possibly demodulating a wirelessly received signal (e.g. from telephone CP as shown in FIG. 9*c*) and for possibly modulating a signal to be transmitted (e.g. as picked up by microphone MIC of the audio gateway AG) and transmitting the (modulated) signal (e.g. to telephone CP), respectively. The listening instrument LI and the audio gateway device AG are connected via a wireless link WLS2, e.g. an inductive link (e.g. two-way or, as shown in FIG. 9*c*, a one-way link), where an audio signal is transmitted via inductive transmitter I-Tx of the audio gateway device AG to the inductive receiver I-Rx of the listening instrument LI. In the present embodiment, the wireless transmission is based on inductive coupling between coils in the two devices or between a neck loop antenna (e.g. embodied in neck strap NL), e.g. distributing the field from a coil in the audio gateway device (or generating the field itself) and a coil of the listening instrument (e.g. a hearing instrument). The audio gateway device AG may together with the listening instrument LI constitute an audio communication system. The audio gateway device AG may constitute or form part of another device, e.g. a mobile telephone or a remote control for the listening instrument LI. The listening instrument LI is adapted to be worn on the head of the user U, such as at or in the ear of the user U (e.g. in the form of a behind the ear (BTE) or an in the ear (ITE) hearing instrument). The microphone MIC of the audio gateway device AG can e.g. be adapted to pick up the user's voice OV during a telephone conversation and/or other sounds in the environment of the user. The microphone MIC can e.g. be manually switched off by the user U.

The first and second audio processing devices each comprises a signal processor (cf. e.g. signal processing unit SP (com/exp) in audio gateway AG of FIG. 9*c* and corresponding unit in listening instrument LI, SP (com/exp)) adapted to impose a compression and/or expansion scheme as described in the present disclosure for enhancing the sound quality or the intelligibility of speech of an audio signal received via a transmission channel of limited bandwidth. The audio gateway AG is adapted to compress a selected audio signal, e.g. the received signal from cellular telephone CT (or from another audio delivery device connected to the audio gateway device) in that the signal processing unit SP of the audio gateway device comprises a frequency transposition scheme for compressing selected received audio signal (cf. e.g. FIG. 3*a*) as described in the present disclosure (including extracting a magnitude of a source and combining it with a phase of a target band). The audio gateway device is further adapted to (possibly modulate and) transmit said compressed signal via the wireless transmission channel WLS2 to the listening instrument LI. The listening instrument LI is adapted to receive the audio signal transmitted via transmission channel WLS2 from the audio gateway device AG and to (possibly demodulate and) expand the received audio signal in that a signal processing unit of the listening instrument comprises a frequency transposition scheme for expanding received compressed audio signal to re-establish the selected audio signal. Alternatively, the listening instrument LI is adapted to use the received and demodulated (compressed) audio signal, either for directly presenting the signal to a user via an output transducer or to further process the compressed signal in a signal processing unit (e.g. to impose a frequency dependent gain and/or a noise reduction algorithm, etc.) before such presentation to a user.

The application scenario can e.g. include a telephone conversation where the device from which a speech signal is received by the listening system is a telephone (as indicated by CT in FIG. 9*c*). The cellular telephone may alternatively or additionally comprise an audio processing device as described in the present disclosure, so that the cellular telephone and the audio gateway (or alternatively the cellular telephone and the listening instrument) constitute an audio communication system as described in the present disclosure. The cellular telephone may alternatively be any other audio delivery device, e.g. an entertainment device (e.g. a TV or a music player or a PC or a combination thereof).

The listening instrument LI can e.g. be a headset or a hearing instrument or an ear piece of a telephone or an active ear protection device or a combination thereof.

An audio selection device or audio gateway AG, which may be modified and used according to the present invention is e.g. described in EP 1 460 769 A1 and in EP 1 981 253 A1 or WO 2008/125291 A2.

In summary, embodiments of the invention may provide one or more of the following advantages:

Improved (perceived) sound quality for a user.

Improved speech intelligibility for a user.

Improved possibilities to compensate for a larger number of different kinds of hearing impairments.

Reduced bandwidth requirements for an audio transmission channel.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims, e.g. in various interplay with techniques for spectral band replication, bandwidth extension, vocoder principles, etc.

References

[Simpson; 2009] Andrea Simpson, Frequency-Lowering Devices for Managing High-Frequency, Hearing Loss: A Review, Trends in Amplification, Vol. 13; No. 2, June 2009, pp. 87-106.

EP 1 686 566 A2 (PHONAK) Aug. 2, 2006

EP 2 091 266 A1 (OTICON) Aug. 19, 2009

[Vaidyanathan, 1993]) P. P. Vaidyanathan, Multirate Systems and Filter Banks, Prentice Hall, 1993.

EP 2 081 405 A1 (BERNAFON) Jul. 22, 2009.

EP 1 460 769 A1 (PHONAK) Sep. 22, 2004

EP 1 981 253 A1 (OTICON) Oct. 15, 2008

WO 2008/125291 A2 (OTICON) Oct. 23, 2008

The invention claimed is:

1. A method of operating an audio processing device to improve a user's perception of an input sound, the method comprising:

defining a critical frequency $f_{crit}$ between a low frequency range and a high frequency range;

receiving an input sound signal representing a sound by said audio processing device;

converting by the audio processing device the input sound signal in a number of frequency bands with a signal processor;

analyzing by the audio processing device said input sound in the number of frequency bands below and above said critical frequency;

defining a cut-off frequency $f_{cut}$ below said critical frequency $f_{crit}$;

identifying a source frequency band above said cut-off frequency $f_{cut}$;

extracting an envelope of said source band;

identifying a corresponding target band below said critical frequency $f_{crit}$;

extracting a phase of said target band; and combining the envelope of said source band with the phase of said target band.

2. The method according to claim 1, wherein said critical frequency is smaller than 8 kHz.

3. The method according to claim 1, wherein said target bands are located between said cut-off frequency $f_{cut}$ and said critical frequency $f_{crit}$.

4. The method according to claim 1, wherein said cut-off frequency is located in a range from 0.01 to 10 kHz.

5. The method according to claim 1, wherein said source bands are located between said cut-off frequency $f_{cut}$ and a maximum source band frequency $f_{max\text{-}s}$.

6. The method according to claim 5, wherein said maximum source band frequency $f_{max\text{-}s}$ is smaller than 12 kHz.

7. The method according to claim 1, wherein the critical frequency $f_{crit}$ is defined relative to a frequency above which the user has a degraded hearing ability.

8. The method according to claim 1, wherein the critical frequency $f_{crit}$ is defined dependent on a user's hearing ability and the available gain.

9. The method according to claim 1, wherein the critical frequency $f_{crit}$ is defined dependent on an upper frequency of a bandwidth to be transmitted in a transmission channel.

10. A method according to claim 1, further comprising:

determining whether the input sound is a voice signal prior to said analyzing the input sound in a number of frequency bands.

11. The method according to claim 1, wherein an appropriate compression or expansion scheme is automatically selected depending on the type of input signal currently being considered.

12. The method according to claim 11, wherein a type of signal is defined by a signal to noise ratio.

13. The method according to claim 11, wherein a type of signal is defined as predominantly speech, predominantly music, predominantly noise, comprising predominantly high frequency components, comprising predominantly low frequency components.

14. The method according to claim 13, wherein a type of speech signal is further defined as being a vowel or a consonant.

15. The method according to claim 13, wherein a type of speech signal is further defined by different consonants.

16. The method according to claim 1, wherein one or more source bands are pre-processed before its/their envelope is/are extracted.

17. The method according to claim 16, wherein the pre-processing comprises a summation or weighting or averaging or max/min identification of one or more source bands before a resulting envelope is extracted.

18. The method according claim 1, wherein a post-processing of an extracted source band envelope value is performed before the source band envelope is mixed with the target band phase.

19. The method according to claim 18, wherein the post-processing comprises smoothing in the time domain.

20. The method according to claim 18, wherein the post-processing comprises a linear or non-linear filtering process.

21. An audio processing device, comprising:

an input signal receiver receiving an electric input signal representing a sound;

a time to time-frequency converter configured to convert the electric input signal in a number of frequency bands;

a frequency analyzer configured to analyze the electric input signal in a number of frequency bands below and above a critical frequency $f_{crit}$;

a signal processor comprising a frequency transposition scheme for identifying a source frequency band above a cut-off frequency $t_{cut}$ below said critical frequency $f_{crit}$ and for identifying a corresponding target band below said critical frequency $f_{crit}$;

an envelope extraction unit for extracting an envelope of said source band;

a phase extraction unit for extracting a phase of said target band; and a combination unit for combining the extracted envelope of said source band with the extracted phase of said target band.

22. The audio processing device according to claim 21, wherein the time to time-frequency converter is a filter bank.

23. The audio processing device according to claim 21, further comprising:

a pre-processing unit for pre-processing one or more source bands before extracting its/their envelope.

24. The audio processing device according to claim 21, further comprising:

a post-processing unit for post-processing one or more extracted target band envelope values.

25. A non-transitory tangible computer-readable medium encoded with instructions, wherein the instructions, when executed on a data processing system, cause the data processing system to perform a method of operating an audio processing device to improve a user's perception of an input sound, the method comprising defining a critical frequency $f_{crit}$ between a low frequency range and a high frequency range;

receiving an input sound by said audio processing device;

analyzing said input sound in a number of frequency bands below and above said critical frequency;

defining a cut-off frequency $f_{cut}$ below said critical frequency $f_{crit}$;

identifying a source frequency band above said cut-off frequency $f_{cut}$;

extracting an envelope of said source band;

identifying a corresponding target band below said critical frequency $f_{crit}$;

extracting a phase of said target band; and combining the envelope of said source band with the phase of said target band.

26. A data processing system, comprising:

a processor; and the non-transitory tangible computer-readable medium according to claim 25 for causing the processor to perform all of the steps encoded on the non-transitory tangible computer-readable medium.

* * * * *